United States Patent [19]

Sickels

[11] Patent Number: 4,663,934

[45] Date of Patent: May 12, 1987

[54] MANIFOLD EXHAUST PROCESSOR

[75] Inventor: Mark A. Sickels, Columbus, Ind.

[73] Assignee: Arvin Industries, Inc., Columbus, Ind.

[21] Appl. No.: 718,539

[22] Filed: Apr. 1, 1985

[51] Int. Cl.[4] ..... F01N 3/02; F01N 3/28

[52] U.S. Cl. ..... 60/302; 60/311; 422/176; 422/179; 422/180

[58] Field of Search ..... 60/299, 302, 311; 422/168, 169, 170, 176, 179, 180; 55/466, DIG. 30

[56] References Cited

U.S. PATENT DOCUMENTS

| | | | |
|---|---|---|---|
| 3,441,381 | 4/1969 | Keith | 60/302 |
| 3,786,635 | 1/1974 | Kates | 60/302 |
| 3,839,862 | 10/1974 | Gota | 422/170 |
| 3,935,705 | 2/1976 | Hergoualch | 60/302 |

FOREIGN PATENT DOCUMENTS

| | | | |
|---|---|---|---|
| 2000046 | 1/1979 | United Kingdom | 60/302 |
| 2074888 | 11/1981 | United Kingdom | 422/180 |

*Primary Examiner*—Douglas Hart

*Attorney, Agent, or Firm*—Barnes & Thornburg

[57] ABSTRACT

A manifold exhaust processor includes a pair of substrates mounted within the interior of an exhaust manifold housing and aligned in end-to-end relation to permit each substrate to treat the combustion product exhausted from a different group of engine cylinders and to equalize the temperatures of the outer skin and centerline portion of the substrate to reduce thermal stress. A common outlet is provided to exhaust the treated combustion product. The first substrate is mounted in a first chamber of the manifold housing in close proximity to a first inlet to cause combustion product to be introduced into the first chamber in a direction toward a side wall of the first substrate to promote tangential flow about the side wall and around the substrate. Likewise, the second substrate is mounted in a second chamber of the manifold housing in spaced-apart, end-to-end relation with the first substrate and in close proximity to a second inlet to cause combustion product to be introduced into the second chamber in a direction toward a side wall of the second substrate, and also to promote tangential flow.

23 Claims, 2 Drawing Figures

MANIFOLD EXHAUST PROCESSOR

Figure 1:
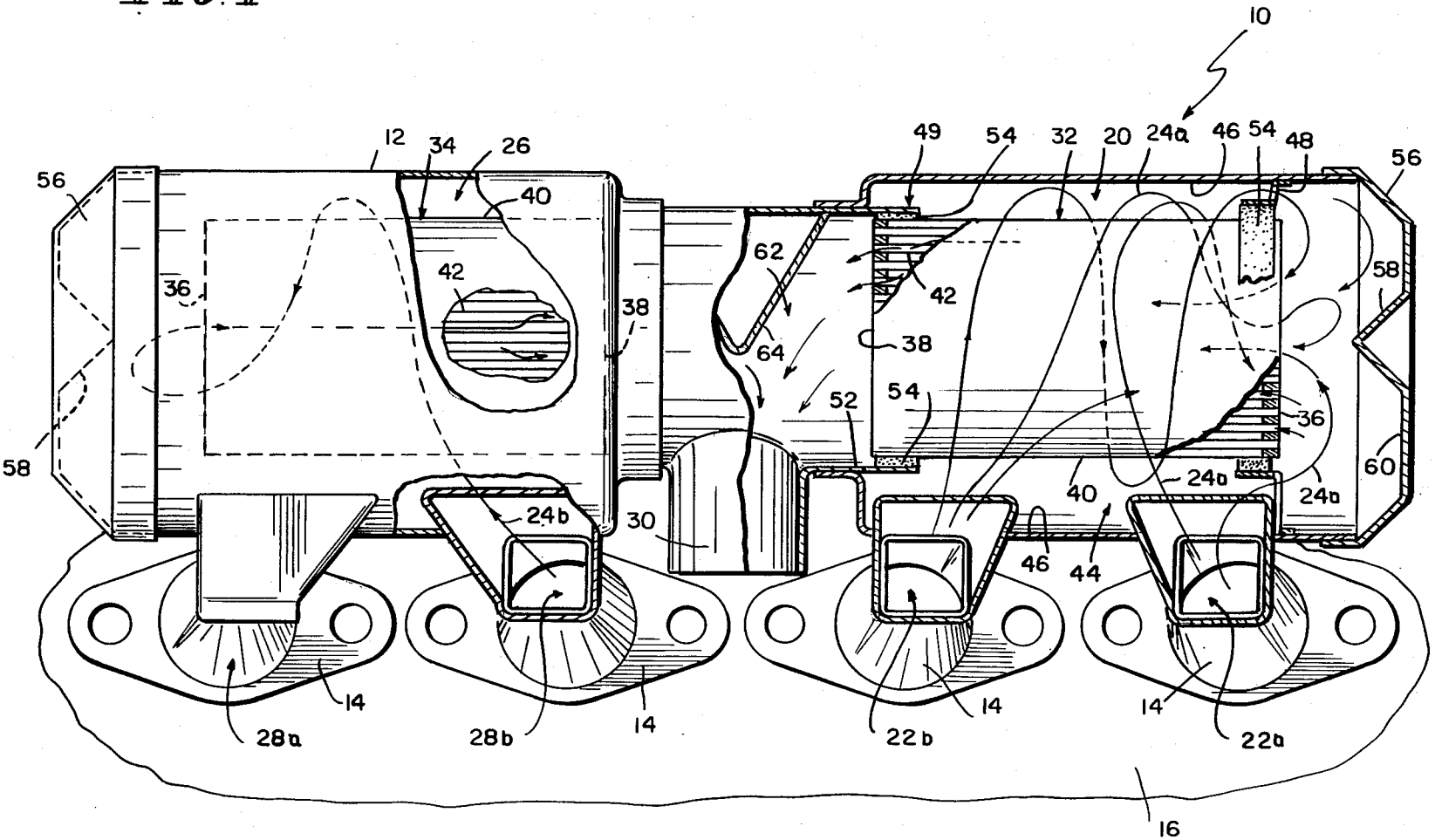

This invention relates to exhaust processors usable to filter particulate matter from a contaminated fluid, and particularly to a mounting arrangement for catalytic reactors and particulate traps. More particularly, this invention relates to an exhaust processor including at least one substrate or filter mounted in an exhaust manifold for treating a contaminated engine exhaust fluid.

In this specification and in the claims, the words "an exhaust processor" are intended to refer to various types of diesel particulate filters, catalytic reactors, and other particulate traps or substrates in connection with which this invention may be used. In addition, a reference to a "substrate" will include the possibility of using a diesel particulate filter or a catalytic converter substrate depending upon the application.

One object of the present invention is to position at least one substrate within the interior of an exhaust manifold of an engine to provide a compact exhaust processor.

Another object of the present invention is to apportion the combustion product emitted by the engine among a pair of substrates to cause the combustion product exhausted from a first group of cylinders to be treated by one of the substrates and the combustion product exhausted from a second group of cylinders to be treated by another of the substrates to provide an efficient exhaust processor.

Yet another object of the present invention is to mount said pair of substrates in end-to-end rotation within the exhaust manifold of an engine, each substrate including an inlet, an outlet, and an exterior side wall extending therebetween, to cause the combustion product to be introduced into the manifold in a radial direction toward the side wall of one of the substrates to permit the flow of combustion product introduced into the exhaust manifold to travel tangentially about the side wall of a substrate prior to treatment therein to improve the compactness of the exhaust processor.

Another object of the present invention is to arrange the pair of substrates within the manifold to cause the outlets of the substrates to confront one another to permit the treated combustion product of the two independent substrates to be exhausted further through a common outlet thereby further improving the compactness of the exhaust processor.

Still another object of the present invention is to arrange the pair of substrates within the manifold to keep an outside skin and a center of the ceramic substrate at an even temperature to reduce thermal stresses in the ceramic substrate thereby reducing the likelihood of failure of the substrate.

According to the present invention, an improved manifold exhaust processor includes at least one substrate disposed in the interior of a housing such as an exhaust manifold to treat combustion product introduced into the manifold from a plurality of engine exhaust ports. The novel exhaust processor desirably includes a housing and a pair of substrates. The housing includes first and second chambers, a first inlet means for introducing combustion product exhausted from a first group of engine cylinders into the first chamber for treatment therein, and a second inlet means for introducing combustion product exhausted from a second group of engine cylinders into a second chamber for treatment therein. The housing is desirably, though not necessarily, an exhaust manifold of an engine. The first and second chambers are adjacent to one another. Each substrate includes an inlet, an outlet, and a side wall extending therebetween.

The first substrate is mounted in the first chamber of the manifold housing in close proximity to the first inlet means to cause combustion product to be introduced into the first chamber in a direction toward the side wall of the first substrate to promote tangential flow about the side wall and around the substrate. Likewise, the second substrate is mounted in the second chamber of the manifold housing in spaced-apart, end-to-end relation with the first substrate and in close proximity to the second inlet means to cause combustion product to be introduced into the second chamber in a direction toward the side wall of the second substrate, and also to promote tangential flow. Each inlet means includes a set of inlet ports formed along a portion of the length of the manifold housing. The pair of substrates are mounted in the interior of the manifold housing to define means for conducting combustion product from the first inlet means to the inlet of the first substrate and from the second inlet means to the inlet of the second substrate.

Provision of the above-described arrangement of substrates in an exhaust manifold is a novel departure from conventional practice. Although the pair of substrates are aligned in end-to-end relation, the substrate pair of the present invention does not cooperate to provide "serial treatment" of one continuous flow of combustion product by each of the substrates in succession as is customary in the case of an exhaust processor having two substrates mounted in an end-to-end or "in-line" configuration. Instead, each substrate is positioned in a different chamber within the manifold housing to lie in separate combustion product path. Thus, one flow or current of combustion product is treated by the first substrate, while another separate flow is treated by the second substrate. This novel structure permits the compact exhaust processor of the present invention to be positioned inside a manifold and to provide exhaust treatment of the type provided by conventional large, bulky, cumbersome "side-by-side" or "parallel" processors which are not so easily installable in an exhaust manifold of standard size and shape.

The pair of substrates of the present invention are advantageously mounted within the interior of the exhaust manifold and aligned in end-to-end relation to permit each substrate to treat the combustion product exhausted from a different group of engine cylinders to provide a more compact exhaust processor by utilizing space more efficiently. The manifold may be a clamshell or rolled shell construction.

The advantage of compactness is achieved in part by the above-described novel arrangement of the substrates within the manifold. The workability of this arrangement is accomplished by the novel conducting means which further includes means for conveying the flow of combustion product that is traveling about the circumference and along the length of each substrate through a channel or conduit defined by an interior end wall of the manifold housing and the inlet end face of the substrate for delivery to the substrate itself for treatment therein.

Additional features and advantages of the invention will become apparent to those skilled in the art upon consideration of the following detailed description of a preferred embodiment exemplifying the best mode of carrying out the invention as presently perceived.

Figure 2:
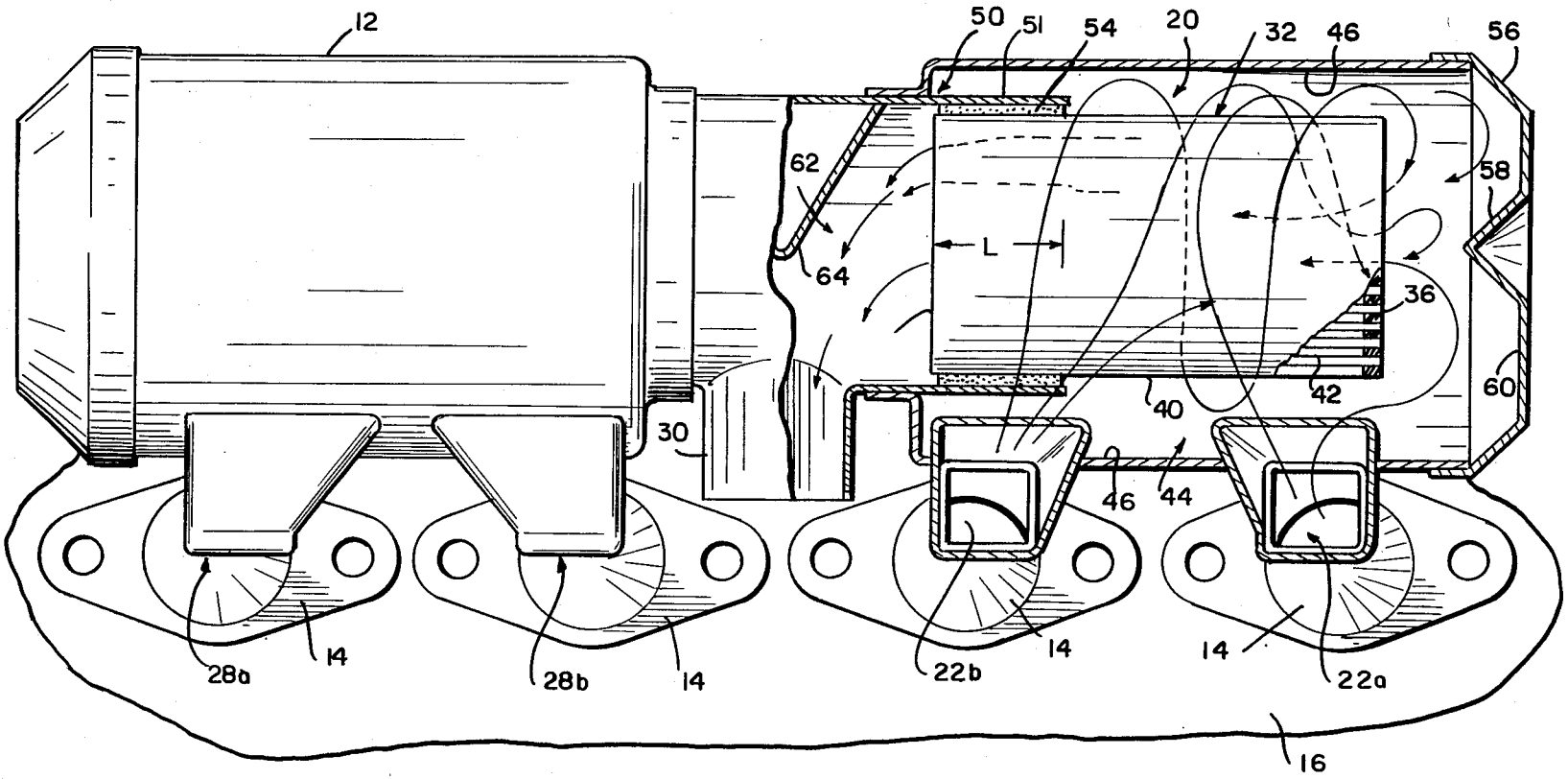

FIG. 1 is a view of one embodiment of the present invention with portions broken away; and FIG. 2 is a view of another embodiment of the present invention with portions broken away.

Preferred embodiments of an exhaust processor 10 of the present invention include a manifold housing 12 in fluid communication with a plurality of exhaust ports 14 of a spark-ignition or compression-ignition internal combustion engine 16. Desirably, the housing 12 is an exhaust manifold as illustrated in the drawing and not a separate structure in communication with the exhaust manifold. Although the housing 12 can be coupled to the exhaust ports 14 of four cylinders of an eight cylinder engine as shown in the drawing, it is within the scope of the present invention to use the exhaust processor 10 in combination with other engines having different cylinder arrangements.

The manifold housing 12 is formed to include a first treatment chamber 20 and a first pair of housing inlets *22a, 22b* for receiving a combustion product portion *24a* of the engine 16 into the first treatment chamber 20. Thus, the first treatment chamber 20 is provided to collect the contaminated gases exhausted from two cylinders of the engine 16. The manifold housing 12 is formed to further include a second treatment chamber 26 and a second pair of housing inlets *28a, 28b* for receiving another combustion product portion *24b* into the second treatment chamber 26 to collect the contaminated gases exhausted from another two of the engine cylinders. Also, a single manifold housing outlet 30 is provided to exhaust combustion product *24a, 24b* from both treatment chambers 20, 26 of the manifold housing 12.

First and second subtrates 32 and 34, respectively, are disposed in the treatment chambers 20, 26 of the manifold housing 12 in a manner to be described. Each substrate is a cylindrically-shaped monolithic cellular structure of conventional diameter and length. Each substrate includes an inlet 36, an outlet 38, and a cylindrical exterior side wall 40 extending between the inlet 36 and outlet 38. Each substrate could be a diesel particulate trap having a large number of thin-walled passages 42 extending between the ends 36, 38 of the cellular structure. It will be understood that the cellular structure could alternatively be of the type used in a catalytic reactor without departing from the scope of the present invention. One significant advantage of the present invention is that a pair of wholly independent substrates of conventional size and shape are usable in an exhaust manifold to provide a compact exhaust processor.

The first substrate 32 is mounted in a particular position in the first treatment chamber 20 to filter or otherwise treat the combustion product *24a* collected therein. The first substrate 32 is mounted within the first treatment chamber 20 to position its exterior side wall 40 in close proximity to the pair of inlets *22a, 22b* as shown. This novel arrangement causes the combustion product *24a* to be introduced into the manifold housing 12 in a direction toward the substrate side walls 40 rather than toward a substrate inlet end in the customary fashion. Thus, a flow of combustion product is first intercepted by the substrate side wall 40 prior to its introduction into the inlet end 36 of said substrate 32.

An annular channel 44 for conducting combustion product from the pair of inlets *22a, 22b* to the inlet 36 of the first substrate 32 is provided by positioning the first substrate 32 in the interior of the manifold housing 12. The cylindrical exterior side wall 40 of the first substrate 32 and a substantially cylindrical interior side wall 46 of the first treatment chamber 20 cooperate to define the annular channel 44 therebetween. Introduction of combustion product *24a* into the annular channel 44 causes a portion of the hot combustion product *24a* to be distributed about the first substrate 32 and flow in a tangential direction in relation to the exterior side wall 40 thereof. At the same time, the annular channel 44 operates to convey substantially all of the combustion product *24a* that is introduced into the first treatment chamber 20 to the inlet 36 of the first substrate 32. Another significant advantage of the present invention is lessening of thermal stresses in a substrate in an exhaust processor. The novel position of the substrate within its treatment chamber operates to equalize the temperature of the outer skin and centerline portion of the substrate. This equalization of the temperatures reduces the thermal stresses or gradients within the substrate and gives greater durability to the substrate.

Although the semi-permeable nature of the substrate may permit a small amount of combustion product *24a* to enter the substrate 32 by radially penetrating the exterior side wall 40 it will be understood that this path will be substantially blocked after a short period of time since the side wall 40 will quickly become clogged with particulate matter entrained in the combustion product *24a*. Thus, the vast bulk of combustion product *24a* will be routed through the longitudinal annular channel 44 for delivery to the inlet end 36 of the first substrate 32. It will be further understood that combustion product flow *24a* will not penetrate the side wall of a catalytic reactor substrate.

One object of the annular channel 44 is to turn the incoming flow of combustion product *24a* toward the inlet end 36 so that the flow can then be conducted through the first substrate 32 for treatment therein. One advantage of the structure of the present invention is that positioning a substrate in the interior of an exhaust manifold results in more effective management of combustion product flow and provides an improved exhaust processor that is substantially more compact than known processors.

In one embodiment of the invention shown in FIG. 1, each substrate 32, 34 is supported at its inlet end 36 and at its outlet end 38. Substrate 32 is supported at its inlet end by a slotted ring 48 rigidly fixed to the interior side wall 46 of the manifold housing 12, and, at its outlet end, 38 by an axially inwardly projecting, cylindrically shaped fixture 49 of rolled shell construction. The fixture 49 is cantilevered at its axially outer end 52 to the housing 12 as shown.

It is within the scope of the present invention to use other substrate mounting means. For example, an alternate embodiment of a substrate mounting means is shown in FIG. 2. An inner support 50 is integral to the manifold housing 12. The inner support 50 includes a support member 51 of length "L". Desirably, length "L" of support member 51 is varied to maximize durability and minimize unexposed filter surface. In one embodiment (not shown) length "L" of the support member is substantially equivalent to the length of the substrate 32. In such a case, the support member can be formed to include a plurality of circumferentially-spaced, longitudinally-extending slots to reduce the likelihood of damage to the substrate 32 due to thermoshock. Mat mount material can be installed between the lengthened support member and the substrate to provide an intermediate cushion.

The exhaust processor 10 further includes a seal 54 embracing the peripheral edge of the exterior side wall 40 at the substrate outlet end 38. The seal 54 is installed intermediate the substrate 32 and either the outlet fixture 49 or inner support 50 to block passage of untreated combustion product therethrough. The seal 54 is desirably constructed of a thin sheet of resilient mat mount material. The same type of material may be installed between the substrate 36 and either the slotted ring 48 or support member 51 to cushion the substrate against any shock transmitted therethrough.

An end cap 56 is installed at each end of the housing 12 in proximity to each substrate 32, 34 as shown. A conically shaped baffle 58 is fixed to an axially inwardly facing surface 60 of each end cap 56 to direct combustion product toward a center portion of the substrate inlet 36.

The manifold housing 12 is further formed to include an exhaust chamber 62 in fluid communication with the outlet ends 38 of both substrates 32 and 34. The now-treated combustion product is collected in the exhaust chamber 62 for distribution to the atmosphere through the exhaust outlet 30 as shown. A substantially V-shaped baffle 64 is fixed to the interior side wall 46 of the manifold housing 12 in confronting relation to the outlet 30 to direct treated combustion product toward said outlet 30 and away from the outlet mouth of the opposing substrate. The V-shaped baffle 64 is designed to direct flow from each chamber toward the outlet and to prevent direct impingement of the exhaust from each side.

Although the invention has been described in detail with reference to certain preferred embodiments and specific examples, variations and modifications exist within the scope and spirit of the invention as described and defined in the following claims.

What is claimed is:

1. A combination exhaust processor and exhaust manifold for mounting in an engine having a plurality of serially arranged exhaust ports, the combination comprising a manifold housing having an interior side wall surface including inlet means for introducing a combustion product of the engine into the manifold housing, substrate means for treating combustion product introduced into the manifold housing through the inlet means, the substrate means being formed to include an inlet, an outlet, and an exterior side wall extending between said inlet and outlet of the substrate means, means for mounting the substrate means within the manifold housing to position the exterior side wall of the substrate means in close proximity to the inlet means to introduce the combustion product into the manifold housing in a direction toward the exterior side wall of the substrate means, and means for conducting combustion product from the inlet means of the manifold housing to the inlet of the substrate means for treatment therein, the conducting means including means for distributing the combustion product about the substrate means to cause at least a portion of the combustion product to flow in a tangential direction in relation to the exterior side wall of the substrate means, the substrate means being mounted within the manifold housing to cause the exterior side wall of the substrate means to cooperate with the interior side wall surface of the manifold housing to define the distributing means so that the combustion product introduced through the inlet means is received therein.

2. The appparatus of claim 1, wherein the substrate means is one of a particulate trap and a catalytic reactor.

3. The combination of claim 1, wherein the substrate means is made of a ceramic material and the ceramic substrate means is positioned within the manifold housing to permit combustion product flowing in the distributing means to equalize substantially the temperature about the periphery of the ceramic substrate means to reduce thermal stresses or gradients within the ceramic substrate means, thereby reducing the likelihood of damage to the ceramic substrate means as a result of thermoshock.

4. The combination of claim 1, wherein the manifold housing includes outlet means for exhausting combustion product and the interior side wall defines a hollow shell for housing the substrate means, the hollow shell has one end in fluid communication with the outlet means and another open end, and a separate end cap is installed at the open end of the hollow shell to aid in defining means for conveying combustion product from the distributing means to the inlet of the substrate means.

5. the combination of claim 4, wherein the end cap includes an axially-inwardly facing surface and baffle means fixed to the axially-inwardly facing surface for directing combustion product toward a center portion of the substrate inlet.

6. The apparatus of claim 1, wherein the conducting means further includes means for conveying the at least a portion of the combustion product from the distributing means to the inlet of the substrate means to cause said combustion product portion to be introduced into the substrate means through said inlet.

7. The apparatus of claim 6, wherein the manifold housing has an interior end wall, the inlet of the substrate means is defined by an inlet end face, and the substrate means is mounted within the manifold housing to cause the inlet end face to cooperate with the interior end wall of the manifold housing to define the conveying means so that the combustion product portion distributed via the distributing means is received therein for delivery to the substrate means.

8. The apparatus of claim 7, wherein the interior end wall includes baffle means for directing said combustion product portion toward a center portion of the inlet of the substrate means.

9. A manifold exhaust processor for use with an engine having a plurality of exhaust ports, the manifold exhaust processor comprising a manifold housing formed to include a first chamber, a second chamber, first inlet means for introducing a combustion product of the engine into the first chamber, second inlet means for introducing a combustion product into the second chamber, and common outlet means for exhausting combustion product from both of the first and second chambers, first and second substrate means for treating combustion product introduced into the manifold housing, each substrate means being formed to include an inlet, an outlet, and an exterior side wall extending between said inlet and outlet, first means for mounting the first substrate means in the first chamber in close proxmity to the first inlet means to introduce combustion product into the first chamber in a direction toward the exterior side wall of the first substrate means, first means for conducting combustion product from the first inlet means of the manifold housing to the inlet of the first substrate means for treatment therein, second means for mounting the second substrate means in the second chamber in close proximity to the second inlet means to introduce combustion product into the second chamber in a direction toward the exterior side wall of the second substrate means, and second means for conducting combustion product from the second inlet means of the manifold housing to the inlet of the second substrate means for treatment therein.

10. The manifold exhaust processor of claim 9, wherein each substrate means is one of a particulate trap and a catalytic reactor.

11. The combination of claim 9, wherein each substrate means is made of a ceramic material and is positioned in its respective chamber in the manifold housing to permit combustion product to flow about the periphery of the substrate means to equalize substantially the temperature about the periphery of each ceramic substrate to reduce thermal stresses or gradients within each ceramic substrate means.

12. The manifold exhaust processor of claim 9, wherein the conducting means includes means for distributing the combustion product about each substrate means to cause at least a portion of the combution product to flow in a tangential direction in relation to the exterior side wall of said substrate means.

13. The manifold exhaust processor of claim 12, wherein the conducting means further includes means for conveying the at least a portion of the combustion product from each distributing means to the inlet of its respective substrate means to cause said combustion product portion to be introduced into the substrate means through said inlet.

14. The manifold exhaust processor of claim 13, wherein the housing has a pair of interior end walls, the inlet of each substrate means is defined by an inlet end face, and each substrate means is mounted within the manifold housing to cause the inlet end face to cooperate with an adjacent interior end wall of the manifold housing to define the conveying means so that the combustion product portion distributed via each distributing means is received therein for delivery to the substrate means.

15. The manifold exhaust processor of claim 14, wherein each interior end wall includes baffle means for directing said combustion product portion toward a center portion of the inlet of the opposite substrate means.

16. An exhaust processor assembly for filtering particulate matter contained in combustion product emitted from an engine exhaust, the exhaust processor comprising a housing having at least one treatment chamber, and at least one inlet means for introducing the combustion product into the at least one treatment chamber, the at least one treatment chamber having an inlet end wall and a side wall, substrate means for filtering particulate matter from the combustion product, the substrate means being located in the at least one treatment chamber and having an inlet end, an outlet end, and an exterior wall extending therebetween, conducting means for directing the fluid flow of contaminated fluid from the at least one inlet means to the inlet end of the substrate means, and mounting means for supporting the substrate means within the interior of the at least one treatment chamber, the mounting means including a circumferential ring rigidly fixed to the interior side wall of the treatment chamber to receive the inlet end of the substrate means and an axially inwardly-projecting, cylindrically-shaped fixture cantilevered to the housing to receive the outlet end of the substrate means.

17. An exhaust processor assembly for filtering particulate matter contained in combustion product emitted from an engine exhaust, the exhaust processor comprising a housing having substantially identical first and second treatment chambers and inlet means for introducing the combustion product into the first and second treatment chambers, each treatment chamber having an inlet end wall and a side wall, a pair of substrate means for filtering particulate matter from the combustion product, one substrate means being located in each of the first and second treatment chambers, each substrate means having an inlet end, an outlet end, and an exterior wall extending therebetween, conducting means for directing the fluid flow of contaminated fluid from the inlet means to the inlet end of each of the first and second substrate means, the conducting means including a pair of annular channels, each annular channel being defined by an outer wall of one of the substrate means and an inner wall of its respective treatment chamber so that the combustion product is conducted along a separate path from the inlet means to the inlet end of each of the substrate means, and mounting means for supporting each substrate means within the interior of its respective treatment chamber, the housing further including an exhaust chamber for collecting the filtered combustion product from each of the substrate means and discharging said combustion product to the atmosphere, the exhaust chamber located in fluid communication with the outlet end of both of the substrate means, the first and second treatment chambers being positioned axially end-to-end such that their respective flow axes are aligned in opposing relation, such placement allowing the outlet ends of the first and second substrate means to use the single exhaust chamber located in fluid communication with and interposed between the first and second treatment chambers.

18. The exhaust processor of claim 17, wherein the housing is an exhaust manifold of the engine, and the inlet means is in direct fluid communication with at least one cylinder of the engine.

19. The exhaust processor of claim 17, wherein each substrate means is located in its treatment chamber such that the axis of flow of the combustion product theough said substrate means is substantially orthogonal to the axis of flow of the combustion product through the inlet means.

20. A combination exhaust processor and exhaust manifold for mounting in an engine having a plurality of serially arranged exhaust ports, the combination comprising a manifold housing including inlet means for introducing a combustion product of the engine into the manifold housing and an interior side wall, substrate means for treating combustion product introduced into the manifold housing through the inlet means, the substrate means being made of a ceramic material, having an outer skin and a center portion, and being formed to include an inlet, an outlet, and an exterior side wall extending between said inlet and outlet of the ceramic substrate means, means for mounting the substrate means within the manifold housing to position the exterior side wall of the substrate means in close proximity to the inlet means and in substantially uniformly spaced relation to the interior side wall of the manifold housing to define an annular passageway therebetween distributing combustion product about the exterior side wall of the substrate means to expose the exterior side wall of the substrate means to combustion product, and means for conducting combustion product from the inlet means of the manifold housing to the inlet of the ceramic substrate means for treatment therein through the annular passageway to equalize substantially the temperature of the outer skin and the center portion of the ceramic substrate means to reduce thermal stresses or gradients within the ceramic substrate means so that failure of the ceramic substrate means due to thermoshock is minimized.

21. The combination of claim 20, wherein the conducting means includes baffle means for directing combustion product distributed through the annular passageway toward a center portion of the inlet of the substrate means.

22. The combination of claim 21, wherein the manifold housing has an interior end wall positioned in spaced-apart opposing relation to the inlet of the ceramic substrate means and the baffle means is fixed to the interior end wall to project toward the inlet of the ceramic substrate means.

23. An exhaust processor assembly for filtering particulate matter contained in combustion product emitted from an engine exhaust, the exhaust processor comprising a manifold housing including first and second inlets for introducing the combustion product into the manifold housing, a common outlet for exhausting combustion products from the manifold housing, first treatment path means for conducting combustion product from the first inlet to the common outlet, and second treatment path means for conducting combustion product from the second inlet to the common outlet, and first and second substrate means for filtering particulate matter from the combustion product, the first substrate means being situated within the first treatment path means, and the second substrate means being situated within the second treatment path means, each substrate means including an inlet end, an outlet end, and a peripheral surface extending therebetween and being positioned in its treatment path means to permit combustion product conducted therethrough to swirl about substantially the entire peripheral surface to heat substantially the entire peripheral surface to about a uniform temperature.

* * * * *